United States Patent [19]

Oak

[11] Patent Number: 4,807,415

[45] Date of Patent: Feb. 28, 1989

[54] VAPOR BARRIER HOLE PLUG

[76] Inventor: Reginald O. Oak, 230 Somerset Ave., Fairfield, Conn. 06430

[21] Appl. No.: 193,169

[22] Filed: May 4, 1988

Related U.S. Application Data

[63] Continuation of Ser. No. 000,169, Jan. 2, 1987, abandoned.

[51] Int. Cl.[4] ..... E04G 23/02; E04B 1/72

[52] U.S. Cl. ..... 52/514; 52/169.14; 52/101

[58] Field of Search ..... 52/101, 169.14, 514, 52/302, 517; 43/132.1; 424/14, 16, 29

[56] References Cited

U.S. PATENT DOCUMENTS

| | | | |
|---|---|---|---|
| 293,726 | 2/1884 | Fancher | 52/514 |
| 3,390,498 | 7/1968 | Roy et al. | 52/514 X |
| 3,699,854 | 10/1972 | Doherty | 52/514 |
| 3,889,436 | 6/1975 | Elliot | 52/514 |
| 4,016,696 | 4/1977 | Mess et al. | 52/514 |
| 4,301,629 | 11/1981 | Farr | 52/514 X |

FOREIGN PATENT DOCUMENTS

| | | | |
|---|---|---|---|
| 2037356 | 7/1980 | United Kingdom | 52/169.14 |

*Primary Examiner*—J. Karl Bell

*Attorney, Agent, or Firm*—Parmelee, Bollinger & Bramblett

[57] ABSTRACT

A plug for sealing holes in concrete to prevent ingress of water and/or vapor, especially after chemical treatment for termites. The plug has a cylindrical, tapered plug body and a sealing lip flaring outwardly at the top end. The plug is fabricated of plastisol with a durometer in the range 75–80, and includes a mold release (polypropylene clylo) to aid in insertion and a fungicide (10,10,-oxybisthenoxarsine) to prevent growth of mold and algae which compromise the seal.

8 Claims, 1 Drawing Sheet

VAPOR BARRIER HOLE PLUG

This is a continuation of co-pending application Ser. No. 169, filed on Jan. 2, 1987, now abandoned.

BACKGROUND OF THE INVENTION

This invention relates to a plug for sealing holes drilled in concrete.

It is sometimes necessary and/or desirable to treat existing homes for termites. This has been accomplished by drilling holes through concrete basement floors or crawl space floors, and injecting chemicals for killing termites and establishing a barrier against termite attack. The hole through which the treatment chemicals were inserted must be sealed both against the ingress of water at times of a high water table, such as following a heavy rain, and also against the ingress of the termite treatment chemicals, either as a vapor or diluted in ingressing water. This was accomplished by inserting a cork in the hole; however, the corks did not provide a satisfactory seal or exhibit the necessary longevity to be ideally suited for the task.

Attempts were made to fabricate plugs of plastic materials, but early attempts along these lines were not completely successful either. In particular, problems occurred in achieving the desired level of sealing and in maintaining the seal in the damp (and sometimes wet) environment where the plugs are used.

SUMMARY OF THE INVENTION

A plug according to the invention herein for sealing holes in concrete or the like comprises a generally cylindrical body portion, which is preferably tapered from a larger diameter top or head surface to a somewhat smaller diameter tip. The tip itself may have a greater taper, to facilitate initial insertion into a hole. A sealing lip extends radially outwardly from the body adjacent the head surface, and the lower surface of the sealing lip is raked outwardly from the body to enter a hole easily. The plug is fabricated of a plastisol material having a durometer of 75 or greater, preferably in the range of 75 to 80, and including a fungicide and a mold release lubricant. The mold release not only can be of benefit in manufacturing the plugs, but also provides some lubrication of the plug as it is forced into a hole. The fungicide prevents the plug from developing a mold or a slippery fungile coating, which are deliterious to the desired sealing.

Accordingly, it is a principal object of the invention herein to provide an improved plug for sealing holes in concrete or the like.

It is an additional object of the invention to provide such a plug which maintains a tight leak-free seal against vapor and moisture.

It is a further object of the invention to provide such a plug which is easy to install, but remains firmly in place.

Other and more specific objects and features of the invention herein will in part be obvious and will in part appear from a perusal of the following description of the preferred embodiment and the claims, taken together with the following drawings.

DRAWINGS

The same reference numerals refer to the same elements throughout the various figures.

DESCRIPTION OF PREFERRED EMBODIMENT

With reference to the various figures of the drawings described above, there is shown a plug 10 according to the invention herein which is well-suited for sealing holes in concrete. The plug 10 generally comprises a body 20 of generally cylindrical configuration and a lip 30 extending peripherally outwardly of the body at the upper end thereof.

Figure 3:
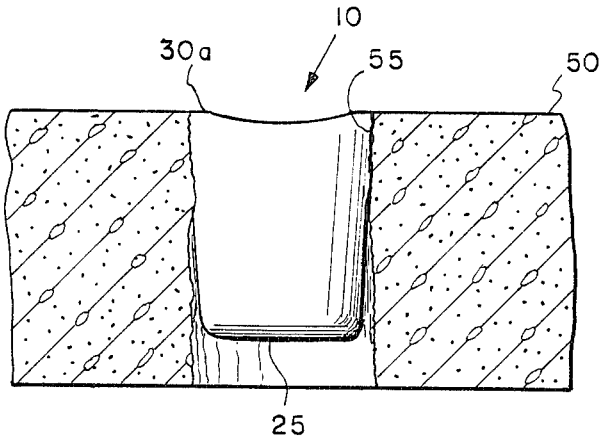
FIG. 3 is a sectional view of the plug of FIG. 1 installed in a hole in concrete.

The plug 10 is used to seal a hole in concrete, as is illustrated in FIG. 3, depicting concrete 50 having a hole 55 formed therein. The hole 55 is drilled in the concrete typically to provide access to inject chemicals used in treating for insect infestations and the like. Common hole sizes used in this trade are one-quarter inch, three-eighths inch, one half inch and three quarters inch. The holes are usually drilled with bits of the foregoing sizes, whereby the holes themselves may be a bit larger because the concrete may chip and pit in the course of drilling. Thus, the interior of the holes is also often not smooth, especially around the top of the hole. The holes also may be somewhat smaller, due to drill bit wear.

Figure 1:
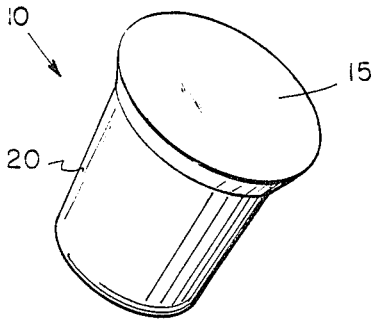
FIG. 1 is a perspective view of a plug according to the invention herein.
Figure 2:
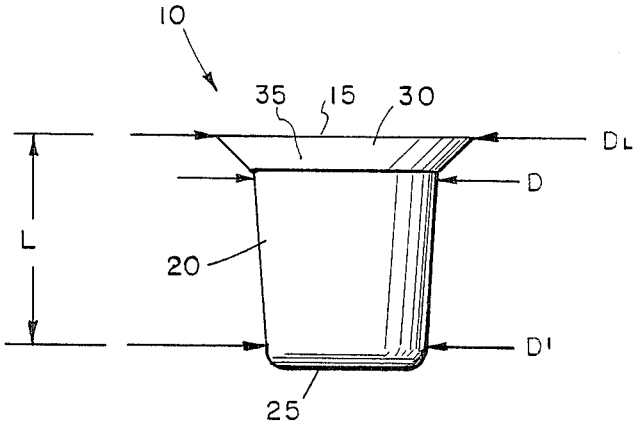
FIG. 2 is a side elevation view of the plug of FIG. 1.

Now with reference to FIG. 1 and 2, the plug body 20 is generally cylindrical, but is preferably slightly tapered inwardly toward the tip end surface 25 of the plug. For the embodiment shown, the diameter D, taken just below the sealing lip 30, may be one half inch for use in a one-half inch hole, and the diameter D′ taken at the tip end 25 of the plug may be approximately 10% less, for instance about seven sixteenths of an inch. The length of the plug 10 may be approximately one-half to three quarters of an inch for a half-inch diameter plug, but the length is not critical.

The lip 30 flares outwardly from the plug body and the lip and plug body define an upper surface 15 of the plug 10. The diameter $D_L$ may be approximately 25 to 50 percent larger than the diameter D of the plug body 20, for example with a half-inch diameter plug, the diameter $D_L$ of the sealing lip may be approximately three-quarters of an inch. As best seen in FIG. 2, the undersurface 35 of the sealing lip 30 flares or rakes outwardly from the plug body 20.

It will be appreciated that plugs to fit other standard size holes are proportioned accordingly.

The plug 10 is installed in hole 55 by inserting the tip, and then placing a dowel or rod on the top surface 15 and driving the plug into the hole. The lip provides the main sealing action, and the plug material must be carefully chosen to be sufficiently compliant to form a good seal, yet sufficiently strong to resist the lip tearing away from the body upon insertion. The flare of the undersurface 35 assists in this regard. As best seen in FIG. 3 at 30*a*, the lip is in intimate contact with the hole edge and bunches up around the periphery of the plug body 20.

To achieve the foregoing desired characteristics, and others discussed below, the plug 10 is preferably fabricated of a plastisol material which has the following characteristics based on a 40-mil film fused at 375° F.: tensile strength, 2300 psi; tare, 190 lbs.; percent elongation, 330%; "shore A" or hardness 77. The hardness or durometer is preferably in the range of 70–80.

The plug material further includes a fungicide and a mold release. The mold release not only assists in removing plugs from molds when forming them, but also provides an amount of lubrication as the plug is inserted into a hole in concrete. Polypropylene clylo is an acceptable mold release agent for this purpose.

The fungicide is also an important element of the plug 10, as the plugs are generally used in a damp environment and may develop a mold or an algae surface coating without the fungicide. Such a surface coating can have a negative effect on the sealing and holding ability of the plug, with respect to both vapor and liquid. A suitable fungicide is 10-10,-oxybisthenoxarsine.

Accordingly, there has been described above a plug which admirably achieves the objects of the invention herein. It will be understood that the description of the preferred embodiment is illustrative only, and that various changes and departures may be made by those skilled in the art without departing from the spirit and scope of the invention herein, which is limited only by the following claims:

I claim:

1. A plug adapted for water and vapor tight sealing of a hole drilled in concrete for the introduction of pesticide chemicals, said plug comprising a generally cylindrical body having a top surface of larger diameter than the hole and tapering to a tip having a smaller diameter than the hole, and including a resilient, compliant peripheral sealing tapered head lip adjacent the top surface, said plug being integrally molded of plastisol having a durometer in the range of seventy-five to eighty and a lubricant substantially mixed throughout the plastisol, whereby said plug is readily drivable into a concrete hole with aid of the distributed lubricant and having its tapered head and lip being deformed into intimate sealing conformiture with the concrete for sealing said concrete hole against water or pesticide chemical vapor.

2. A plug adapted for water and vapor tight sealing of a hole drilled in concrete as defined in claim 1 wherein the lubricant substantially mixed throughout the plastisol is polypropylene clylo.

3. A plug adapted for water and vapor tight sealing of a hole drilled in concrete as defined in claim 1 and further comprising a fungicide for maintaining the sealing interface between the plug and the concrete free of growth that would impair the sealing and holding capability of the plug.

4. A plug adapted for water and vapor tight sealing of a hole drilled in concrete as defined in claim 3 wherein the fungicide is 10-10, -oxybisthenoxarsine.

5. A plug adapted for water and vapor tight sealing of a hole drilled in concrete for the introduction of pesticide chemicals, said plug comprising a generally cylindrical body having a top surface of larger diameter than the hole and tapering to a tip having a smaller diameter than the hole, and including a resilient, compliant peripheral sealing tapered head lip adjacent the top surface, said plug being integrally molded of plastisol having a durometer in the range of seventy-five to eighty and a fungicide substantially mixed throughout the plastisol, whereby the plug is drivable into a concrete hole and having its tapered head and lip being deformed into intimate sealing conformiture with the concrete for sealing said concrete hole against water or pesticide chemical vapor and maintains said sealing by resisting the growth of fungus or algae on the surface of the plug interfacing with the concrete.

6. A plug adapted for water and vapor tight sealing of a hole drilled in concrete as defined in claim 5 wherein the fungicide is 10-10, -oxybisthenoxarsine.

7. A method of forming and sealing a hole in concrete against the passage of water or pesticide vapor, the method comprising:

A. forming a tapered plug including a tapered head sealing lip from a mixture of plastisol and lubricant with a durometer in the range of seventy-five to eight;

B. forming a hole through the concrete and applying pesticide through said hole; and C. inserting the tapered plug into the hole and driving the tapered head sealing lip into deformed intimate sealing contact with the cement defining the hole to prevent the passage of water or pesticide vapor.

8. The method of forming and sealing a hole in concrete as defined in claim 7 wherein the step of forming a tapered plug includes mixing a fungicide with the plastisol and lubricant, the fungicide inhibiting the growth of fungus or algae on the surface of the installed plug.

* * * * *